United States Patent [19]

Towsend

[11] 4,379,515

[45] Apr. 12, 1983

[54] AUTOMATIC DISPENSER FOR RINSE WATER ADDITIVE

[76] Inventor: Marvin S. Towsend, 1365 Potomac Heights Dr., Fort Washington, Md. 20744

[21] Appl. No.: 305,720

[22] Filed: Sep. 25, 1981

[51] Int. Cl.[3] ..... B67D 5/08

[52] U.S. Cl. ..... 222/52; 222/463; 222/94; 222/95; 68/17 R

[58] Field of Search ..... 222/52, 463, 94, 95, 222/129, 564, 105, 107, 214; 68/17 A, 17 R; 137/38; 134/100, 101

[56] References Cited

U.S. PATENT DOCUMENTS

| | | | |
|---|---|---|---|
| 2,956,709 | 10/1960 | Nison et al. | 222/463 X |
| 3,044,665 | 7/1962 | Ludwig et al. | 222/129 |
| 3,108,722 | 10/1963 | Torongo, Jr. et al. | 222/463 |
| 3,215,311 | 11/1965 | Nison et al. | 222/52 |
| 4,026,131 | 5/1977 | Dugger et al. | 68/17 A |

*Primary Examiner*—Joseph J. Rolla

*Assistant Examiner*—Kevin P. Shaver

[57] ABSTRACT

The object of the invention is to provide a free body dispenser for a washing machine wherein the dispenser employs premeasured and preloaded laundry additive units. It is not necessary to measure out additive from a storage bottle. Another object is to provide a dispenser which will not clog and will not have moving parts to wear out. Dispenser (1) has a reservoir (2), a conduit (4), and a receptacle (3). The reservoir (2) has a quantity of additive (6) within a collapsible wall (5). During the spin cycle of the washing machine, centrifugal forces squeeze the additive (6) out of the reservoir (2), through the conduit (4), and into the rigid receptacle (3). When the spin cycle is over, the rinse cycle begins; and clean water is added to the machine. Clean water enters the receptacle (3) and dilutes the retained additive (6). All the additive (6) is diluted with water and rinsed out of the receptacle (3) during the agitation phase of the rinse cycle.

10 Claims, 4 Drawing Figures

AUTOMATIC DISPENSER FOR RINSE WATER ADDITIVE

TECHNICAL FIELD

The invention relates to free body dispensers for automatically dispensing a laundry additive to the rinse water in an automatic washing machine.

BACKGROUND ART

Free body dispensers for dispensing a laundry additive in an automatic washing machine are disclosed in the following U.S. Pat. Nos.: 3,108,722 to Torongo et al.; U.S. Pat. No. 3,174,647 to Ludwig; U.S. Pat. No. 3,180,538 to Brown et al.; U.S. Pat. No. 3,215,311 to Nison et al.; and U.S. Pat. No. 3,888,391 to Merz. The free body dispensers disclosed in the cited patents share a common characteristic in having mechanical valves controlled by the centrifugal forces generated as the automatic washing machine undergoes a spin cycle. In general, the valve mechanisms are complex in operation and are relatively expensive to manufacture.

The prior art free body dispensers are designed to be filled by the operator of the washing machine just prior to use. This requires the operator to handle a storage bottle of additive, generally a liquid. The inconvenience of filling the dispenser and the risk of spillage during the filling are significant deterrents which cause many persons to forego using the dispensers.

In that the same dispenser is used over and over and in that the internal structure of the dispensers are generally complex, there is a likelihood that the inner workings will clog up, corrode, or simply wear out.

None of the cited dispensers are adapted to be used in conjunction with a premeasured and preloaded additive reservoir.

DISCLOSURE OF INVENTION

In view of the deficiencies and inadequacies described above, it an object of the invention to provide an automatically dispensing free body dispenser of simple design and not having mechanical valves controlled by the centrifugal forces generated during the spin cycle in an automatic washing machine.

Another object of the invention is to provide a free body laundry additive dispenser which does not require the operator to fill the dispenser using a storage bottle just prior to doing the laundry.

Another object of the invention is to provide a free body laundry additive dispenser having a portion which may be used over and over but which has a simple design without moving parts that can clog, corrode, or wear out.

Still another object of the invention is to provide a free body laundry additive dispenser which is designed to be used in conjunction with a premeasured and preloaded laundry additive reservoir.

Additional abjects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention as embodied and broadly described herein, the automatic dispenser for rinse water additive of the invention has a reservoir with a collapsible wall, the reservoir having a premeasured and preloaded quantity of laundry additive therein. The reservoir is connected to a rigid receptacle by means of a conduit. When the washing machine undergoes a spin cycle just prior to filling with clean rinse water, centrifugal forces are exerted on the reservoir and collapse the wall squeezing the additive through the conduit into the rigid receptacle which retains its form and shape during the spin cycle. The additive is retained in the receptacle until it is diluted by and mixes with the clean rinse water as the laundry tub is filling.

Preferably, the additive reservoir and the rigid receptacle are removably connected by means such as, for example, complementary threads.

Preferably, the conduit extends into the receptacle a sufficient distance so that after the additive has been squeezed out of the reservoir, the tip of the conduit is above the level of the liquid retained by the receptacle.

Preferably, a flow restrictor such as, for example, a simple constriction in the conduit, restricts the flow of the additive from the reservoir to the receptacle during the agitation cycle of the washing machine but permits the additive to flow from the reservoir to the receptacle during the spin cycle.

In the structure of the rigid receptacle, the receptacle preferably includes two hollow projections which project into the receptacle. The projections have openings at both ends allowing communication between the inside and outside of the receptacle. The hollow projections, in conjunction with the inner wall of the receptacle, form annular cups to retain the additive in the receptacle as the laundry tub is filling with clean water during the rinse cycle. These cups, in retaining the additive prior to dilution with rinse water, prevent concentrated additive from coming into direct contact with the laundry.

Preferably, the size of the openings of one hollow projection is larger than the size of the openings of the other hollow projection. This disparity in size allows for efficient dilution of the additive concentrate with incoming clean water into the annular cups of the receptacle.

Preferably, the distance that the hollow projections project into the receptacle is sufficient to be above the level of the additive retained by the receptacle after the spin cycle is over. In this way, concentrated additive is prevented from overflowing the annular cups and coming into contact with the laundry.

By employing the dispenser of the invention, an operator may use a premeasured and preloaded laundry additive reservoir by connecting the reservoir to a rigid receptacle by screwing the reservoir into the receptacle. The receptacle is of simple structure and has no moving parts to clog or wear out. The annular cups created by the hollow projections and the wall of the receptacle prevent concentrated additive from coming into contact with the laundry. A flow restrictor in the conduit between the reservoir and the receptacle prevents additive from entering the receptacle prior to being squeezed into the receptacle by the centrifugal forces generated during the spin cycle.

BRIEF DESCRIPTION OF DRAWINGS

The accompanying drawings, which are incorporated in and form a part of the specification, illustrate an embodiment of the present invention and, together with the description, serve to explain the principles of the invention. In the drawings.

BEST MODE FOR CARRYING OUT THE INVENTION

Figure 1:
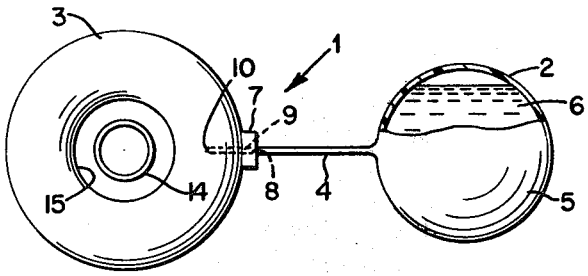
FIG. 1 is a top view of an embodiment of the invention before use in the washing machine.

With reference to FIG. 1 in the drawings, automatic dispenser 1 includes a reservoir 2 which has a collapsible wall 5. A quantity of laundry additive 6, such as a liquid fabric softener added to the rinse cycle in the washing machine, is contained in the reservoir 2. A rigid receptacle 3 communicates with the reservoir 2 through conduit 4.

The additive 6 in the receptacle 3 is diluted by water during the rinse cycle and is dispensed into the wash tub. All the additive 6 is diluted and rinsed out of the receptacle 3 after the washing machine tub fills up with clean water, and the agitation phase of the rinse cycle takes place.

Although the reservoir 2, the receptacle 3, and the conduit 4 may be formed as a unified structure which may be used as a premeasured and preloaded dispenser which is disposable after one use, preferably, the reservoir 2 may be removed from the receptacle 3 after one use. The reservoir 2 is replaced after one use, whereas the receptacle 3 may be used over and over again. Connecting nut 7 has nut threads 8 which are complementary to the screw threads 9 on the conduit 4. After one use, a reservoir may be unscrewed from the receptacle 3 and replaced with a fresh one.

The conduit 4 has a flow restrictor 10 which restricts the flow of the laundry additive 6 from the reservoir 2 to the receptacle 3 during the agitation cycle of the washing machine but permits flow of the additive 6 from the reservoir 2 to the receptacle 3 during the spin cycle. The flow restrictor 10 may simply be a constriction in conduit 4.

Figure 2:
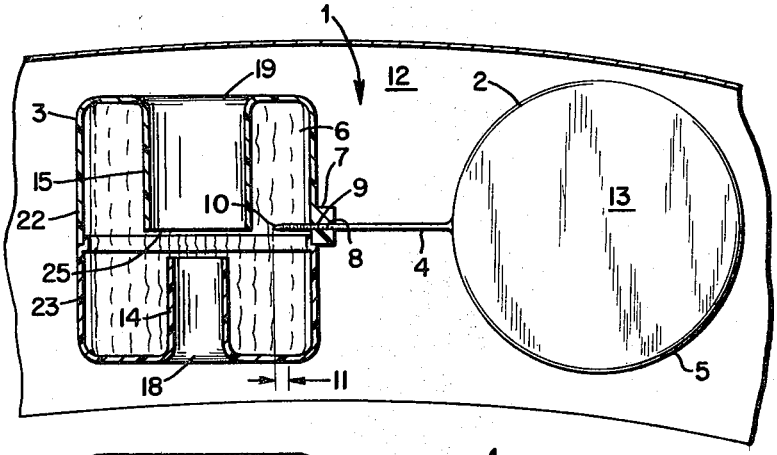
FIG. 2 is a side, cross-sectional view of the embodiment shown in FIG. 1 during the spin cycle in the washing machine.

In FIG. 2, the receptacle 3 has first hollow projection 14 which has openings 18 and has second hollow projection 15 which has outer opening 19 and inner opening 25.

In FIG. 2, the dispenser 1 is undergoing the spin cycle. Centrifugal forces are generated substantially perpenducular to the plane of the drawing paper. Under these forces, especially if sandwiched between some laundry (not shown) and the wall 12 of the washing machine tub, reservoir 2 is squeezed and flattened into a pancake-like form 13. In FIG. 1, the shape of the reservoir 2 before being added to the washing machine is spherical.

In FIG. 2, the additive 6 assumes a somewhat vertical orientation as it is subjected to the centrifugal forces during the spinning of the tub. The conduit 4 extends above the level of the additive 6 providing a clearance 11. Clearance 11 prevents any additive 6 from being sucked back into the reservoir 2 when the spinning stops if there is substantial elasticity in the collapsible wall 5 so that it tends to assume its unstressed shape.

Figure 3:
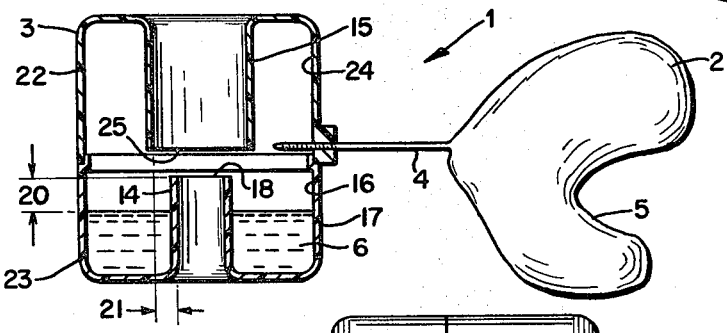
FIG. 3 is a view of the embodiment shown in FIG. 2 after the spin cycle has been completed and the dispenser is oriented substantially horizontally.

FIG. 3 shows the dispenser oriented substantially horizontally after the spin cycle has ceased, and the washing machine begins the rinse cycle by filling with clean water. Collapsible wall 5 of reservoir 2 is shown to be flaccid and not returning to its original spherical shape shown in FIG. 1. Additive 6 is pooled at the bottom of the receptacle. A first annular cup 16 is formed between the first hollow projection 14 and the wall 17 of the receptacle. Additive 6 is contained in the annular cup 16.

So that the concentrated additive 6 not contact any of the laundry prior to its being diluted by the rinse water, the first hollow projection projects above the level of the additive 6 by clearance 20 which prevents additive 6 from spilling out of the first annular cup 16.

It is understood that if the horizontally oriented dispenser 1 were rotated about 180 degrees, then the pool of additive 6 whould be contained in the second annular cup 24 which is formed by the second hollow projection 15 and the wall 17 of the receptacle 3.

The second hollow projection 15 is of greater diameter than the first hollow projection 14. The difference in size is represented by clearance 21. By having a disparity in the diameter in the hollow projection openings, entry and exit of clean rinse into and out of the receptacle 3 is facilitated. Thereby, dilution of the concentrated additive 6 is speeded up.

Figure 4:
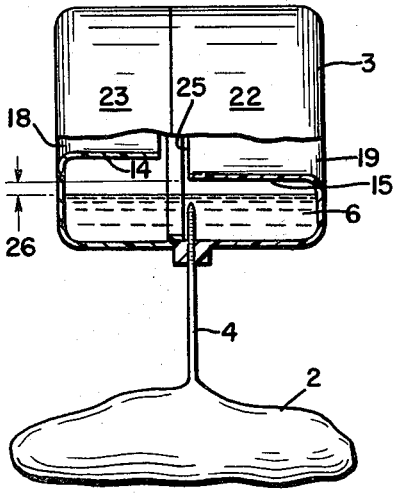
FIG. 4 is a view of the embodiment shown in FIG. 2 after the spin cycle has been completed and the dispenser is oriented substantially vertically.

FIG. 4 shows the dispenser oriented substantially vertically after the spin cycle has stopped. The additive 6 is pooled in the receptacle 3. In order to prevent the additive 6 from spilling out of the receptacle 3 onto the laundry before it is diluted, a clearance 26 is provided between the level of the additive 6 and the inner opening 25 of the second hollow projection 15.

It is understood that if the vertically oriented dispenser 1 were rotated about 180 degrees, then the pool of additive 6 would rest in the region of the receptacle 3 opposite to the conduit 4.

The entire dispenser 1 may be fabricated from plastic materials. Flexible, non-resilient film may be used for the reservoir 2. Rigid plastics may be used for the receptacle 3, conduit 4, and nut 7.

Certain polyethylenes are less dense than water. If such a polyethylene is used for fabricating a dispenser of the invention, then the dispenser will float in the wash tub. A floating free body dispenser is impacted by the washing machine agitator less during the agitation cycle than a free body dispenser that sinks in the wash tub water. Even though a flow restrictor 10 limits the effect of the agitator's impacting the dispenser of the invention, reduced agitator impacting on the dispenser is desirable.

In forming the receptacle 3, a unitary piece of plastic may be molded. Alternatively, two pieces 22 and 23 may be formed separately and then assembled into a unified receptacle 3.

Although the laundry additive used in the invention is generally a liquid, it may also be in the form of a paste or gel.

In view of the foregoing, utilizing the dispenser of the invention provides advantages and benefits. The receptacle 3 has no moving parts and will not clog or corrode during repetitive use. Adequate space is provided between the hollow projections and the level of additive 6 during use of the dispenser 1 so that no additive 6 concentrate will spill out of the receptacle 3 and contact the laundry prior to being diluted by the clean rinse water. A reservoir 2 may be removed after use and replaced by a fresh reservoir 2 which is connected to the receptacle 3 which is used repeatedly. Thus, a premeasured and preloaded quantity of additive 6 may be employed with an automatic free body dispenser for the rinse cycle in an automatic washing machine.

The description of the embodiment set forth above has been presented for purposes of illustration and description. It is not intended to be exhaustive or to limit the invention to the precise form disclosed. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An article for automatically dispensing laundry additive during the rinse cycle in an automatic washing machine, comprising:

a reservoir having a collapsible wall and a quantity of laundry additive, said wall being collapsible during the spin cycle of the automatic washing machine;

a rigid receptacle for receiving the laundry additive and for dispensing the laundry additive; and a communication means for passing the laundry additive from said reservoir to said receptacle during the spin cycle.

2. An article as described in claim 1 wherein said communication means includes a flow restrictor means which restricts the flow of the laundry additive from said reservoir to said receptacle during the agitation cycle of the washing machine but permits flow of the additive from said reservoir to said receptacle during the spin cycle.

3. An article as described in claim 1, further comprising means for removably connecting said reservoir with said receptacle.

4. An article as described in claim 3 wherein said removable connecting means are complementary threads.

5. An article as described in claim 1 wherein said communication means includes a conduit means between said reservoir and said receptacle.

6. An article as described in claim 5 wherein said conduit means extends into said receptacle a sufficient distance to provide a clearance between the laundry additive retained by said receptacle during the spin cycle and the end of said conduit means.

7. An article as described in claim 1 wherein said receptacle includes hollow projection means projecting into said receptacle forming annular cup means with the wall of said receptacle; and wherein said hollow projection means have openings at both ends providing communication between the inside and outside of said receptacle.

8. An article as described in claim 7 wherein said hollow projection means project into said receptacle a sufficient distance to provide a clearance between the laundry additive retained by said receptacle after the spin cycle is over and an inner opening in said hollow projection means.

9. An article as described in claim 7 wherein said hollow projection means include a first hollow projection means and a second hollow projection means, the openings of said second hollow projection means being larger than the openings of said first hollow projection means.

10. An article as described in claim 9 wherein the inner opening of said second hollow projection means is spaced a sufficient distance from the wall of said receptacle thereby providing a clearance between said inner opening and the laundry additive after the spin cycle is over, and the dispenser is oriented in a substantially vertical orientation.

* * * * *